US005496026A

United States Patent [19]

Montgomery

[11] Patent Number: 5,496,026

[45] Date of Patent: Mar. 5, 1996

[54] SPONGE EGGBALL

[76] Inventor: Lawrence M. Montgomery, 300 Northlake Dr., Crystal Bay, Nev. 89402

[21] Appl. No.: 437,697

[22] Filed: May 9, 1995

Related U.S. Application Data

[63] Continuation-in-part of Ser. No. 249,782, May 26, 1994, Pat. No. 5,413,332.

[51] Int. Cl.[6] ..... A63B 37/02

[52] U.S. Cl. ..... 273/58 R; 273/58 E; 273/58 G; 273/58 J

[58] Field of Search ..... 273/58 R, 58 E, 273/58 G, 58 J, 58 K, 428, DIG. 10

[56] References Cited

U.S. PATENT DOCUMENTS

| | | | |
|---|---|---|---|
| D. 312,845 | 12/1990 | Matsuda | D21/104 |
| 890,920 | 6/1908 | Newbold | 273/58 K |
| 1,515,786 | 11/1924 | Munro | 273/58 E X |
| 2,743,931 | 5/1956 | Pooley et al. | 273/58 J X |
| 3,195,267 | 7/1965 | Gehlen | 446/168 |
| 3,241,834 | 3/1966 | Stingley | 273/58 J |
| 3,660,930 | 5/1972 | Indjian | 446/297 |
| 3,712,627 | 1/1973 | Stroud | 273/128 A |
| 3,740,354 | 6/1973 | Dearmont | 273/58 J X |
| 3,885,795 | 5/1975 | Brewer | 273/176 |
| 3,930,650 | 1/1976 | Watson | 273/58 R X |
| 4,003,573 | 1/1977 | Craig, Jr. | 273/58 R |
| 4,067,569 | 1/1978 | Palumbo | 272/67 |
| 4,219,959 | 9/1980 | Fleischer | 446/486 |
| 4,698,043 | 10/1987 | May et al. | 446/273 |
| 4,930,777 | 6/1990 | Holenstein | 273/65 |
| 5,066,011 | 11/1991 | Dykstra et al. | 273/58 G |
| 5,413,332 | 5/1995 | Montgomery | 273/58 R |

*Primary Examiner*—William H. Grieb

[57] ABSTRACT

An egg-shaped sponge rubber or foam elastomeric plastic ball having a unique combination of texture, size, weight and sponge material compositional features such that it can be thrown and bounced in a controllable manner, after the user develops a certain level of skill. Methods of manufacture and very safe indoors and out-of-doors in use in exercise, entertainment and sports training are also described. The sponge eggball has a major to minor axis ratio on the order of 1.3 to 1.6 and more preferably in the range of 1.4 to 1.5, a major axis dimension in the range of about 2½" to 4½", a mass on the order of from 30 to 90 grams, and preferably in the range of from 50 to 70 grams, and optionally an exterior skin surface that while smooth, is grippable. The density is between about 5 to 20 psi and preferably from about 10 to 12 psi by ASTM #D-1056. In the preferred embodiment, the sponge is provided in several graded levels in sizes from 3–4" along the major axis. A first, or "easy" grade comprises a very soft sponge eggball of slow rebound for children and beginners, and is particularly safe for indoor use. A more dense sponge eggball may be provided for an intermediate skill, 2nd level training, and outdoor use.

20 Claims, 2 Drawing Sheets

SPONGE EGGBALL

CROSS-REFERENCE TO RELATED APPLICATION

This application is a continuation in part of my prior, copending application to EGGBALL, Ser. No. 08/249,782 filed May 26, 1994, now U.S. Pat. No. 5,413,332, issued May 9, 1995, the disclosure of which is hereby incorporated by reference.

FIELD

This invention relates to exercise and entertainment devices, and more particularly to an amusement device comprising a special ball generally of egg-shaped configuration having a unique combination of texture, size, weight and composition features such that it can be thrown and bounced in a controllable manner, after the user develops a certain level of skill. Methods of use and manufacture are also described. More particularly, the composition is an elastomeric sponge rubber or plastic for indoor use, and for safety, especially when used by children.

BACKGROUND

Balls, of which there are a wide variety, are a classic play toy which in many of its variations are used in athletics. Most balls are spherical so that the ball can be controlled and the bounce or rebound can be predicted. There are both high rebound balls, of high durometer elastomeric plastic of cured urethane, polybutadiene and other polymer compositions, and soft, low rebound balls of sponge rubber or open or closed cell plastic. To Applicant's knowledge, while small 1–2" oval-shaped elastomeric balls are available, there are no properly-sized exercise or athletic balls that are egg-shaped due to the user's inability to control the ball and/or predict its rebound.

A number of toys have been proposed using egg-shaped balls, among them, Gehlen U.S. Pat. No. 3,195,267, which is directed to a V-shaped trough having legs at one end to form an incline down which is rolled an egg or "synthetic", non-bounceable egg. The synthetic egg is a shell containing heavy grease and having a smaller round ball or heavy weight embedded in the grease to provide a center of gravity.

Stroud U.S. Pat. No. 3,712,627 shows an egg-shaped elastomeric ball having a hollow space at the large end. This ball is specifically engineered to have a center of gravity space between the center of the major axis and the longitudinal midpoint. One end is hemispherical and the other parabolic with essentially no transition zone therebetween.

Craig U.S. Pat. No. 4,003,573 shows an irregularly shaped ball, generally oval in shape, having both ridges and grooves between the ridges to provide erratic and unpredictable bounces. Fleischer U.S. Pat. No. 4,219,959 is a toy egg composed of two intertwined helically cut shells of plastic. Brewer U.S. Pat. No. 3,885,795 is directed to an egg-shaped golf ball with a dimpled surface for a miniature golf game.

None of these balls have been taught to be thrown except for Craig U.S. Pat. No. 4,003,573 and Fleischer U.S. Pat. No. 4,219,959. The former clearly indicates that the ball is not controllable because of the ridges and grooves. It derives its amusement effect from the unpredictability of the rebound.

All of these balls eliminate the skill factor, which is one of the greatest satisfactions in amusement, athletic and entertainment devices. Accordingly, there is a need for an improved ball which due to its non-round shape provides a high degree of control challenge.

THE INVENTION

OBJECTS

It is among the objects of this invention to provide a generally egg-shaped ball which due to its surface texture, size, weight, configuration and sponge composition is safe for indoor use and can be controlled and function as an amusement, entertainment and athletic ball.

It is another object of this invention to provide an egg-shaped sponge ball and a method for throwing it so that its rebound can be controlled and predicted, thereby presenting a challenge to the user, who through acquired technique can learn to use and control the ball for amusement, exercise or athletic training purposes.

It is another object of this invention to provide a novelty device in the form of an egg-shaped sponge ball, the composition of which can be controlled during manufacturing to provide varying degrees of softness for graded rebound characteristics and for safe indoor use.

Still other objects will be evident from the specification, claims and drawings of this application.

DRAWINGS

The invention is illustrated in references to the drawings in which:

FIG. 3 is a side view of the left hand of a player showing how the sponge eggball can be squeezed, and rotated and thrown downwardly in a beginners throw;

SUMMARY

Figure 1:
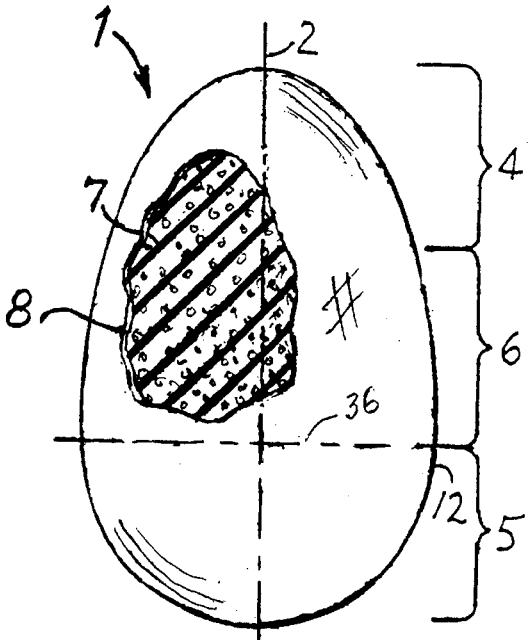
FIG. 1 is a side elevation of the sponge eggball of this invention, with a portion broken away to show the interior sponge nature thereof.

The invention comprises a generally egg-shaped ball (called herein an "eggball" as a descriptive term) having a special configuration, weight, dimensions, surface textures and sponge material composition and density, which sponge eggball useful for novelty, entertainment, exercise and athletic training. More specifically, the sponge eggball of this invention has a major to minor axis ratio on the order of 1.3 to 1.6 and more preferably in the range of 1.4 to 1.5, has a major axis dimension in the range of about to 2½" to 4½", and preferably in the range of from 3" to 4", has a mass on the order of from 30 to 90 grams, preferably in the range of from 50 to 90 grams, and has an exterior skin with a surface that while smooth, may be textured. The sponge compressibility density is from 5 to 20 psi and preferably between 10 to 12 psi, as measured by ASTM test D-1056, a compression deflection test.

As compared to the high rebound characteristic elastomeric plastic composition of my prior application Ser. No. 249,782, sponge eggballs are softer, do not rebound as well and are generally easier for children to catch as they can be squeezed for a better grip. In this class are included foam rubber, open cell elastomeric plastics and closed cell elastomeric plastics, the density, compressibility and resilience of which can be controlled by selecting composition and curing. The elastomeric sponge composition may be any conventionally available type, e.g., natural rubber or synthetic elastomers (e.g., latex, silicone, polyolefin, butyl, butadiene, and copolymers), with natural rubber being preferred.

The sponge eggballs of this invention are safe to use, particularly in cases of small children when hit by the ball upon missing a catch. They can also be used indoors without damaging furnishing or walls. The sponge eggballs are also good for training, as the slower bounce can be a starting point for learning to play with an eggball. Speed of rebound characteristics can be controlled by graduated "sponginess," e.g., sponge density and cured hardness, thickness of exterior skin, composition and the like. Thus, a set of eggballs may be packaged together, e.g., a soft sponge eggball, a higher density sponge eggball, and finally, a high density, high rebound "pro" eggball of my copending parent application Ser. No. 249,782.

The rebound of a thrown sponge eggball can be predicted and controlled by an appropriate throw. While a wide variety of spins and motions can be imparted, which will be evident to the user after practice, several types of throwing motion are of particular interest. Generally, the ball may be spun on its major axis, either large end down or small end down, so as to impact on that chosen end. The rebound characteristics differ, of course, in that the larger end provides a larger compression surface, and exhibits a different characteristic of rebound than striking on the small end. In addition, the ball can be held with the major axis oriented generally horizontally. In this orientation there are two major alternative positions: First, the major axis is oriented transverse to the players body, and second, the major axis is oriented in the direction the player's body is facing. In the first instance, imparting a spin around the major axis permits the ball to strike on its side in the relatively flat transition zone between the large end, which is generally hemispherical, and the small end, which is generally parabolic, in cross-section or oval. For a long distance throw against the ground, the ball can be thrown underhand or overhand. For an underhand throw, (i.e., a palm-up throw), long bounces can be obtained with alternating bounces on the large end and the small end by holding the ball in the palm of the hand and throwing it with a quick downward rotation of the wrist so that the ball is tipped end over end off the fingertips toward the ground. The ball can be thrown overhand to the ground for higher or longer bounces.

In one particularly interesting and challenging game, the ball can be used as a handball or paddleball in a squash or handball court, or on a pelote court. While the hands may be used, a wide variety of conventional implements such as handball gloves, squash rackets, or pelote catchers can be used. After some practice, a player can control the direction of throw and the end or portion of the ball which impacts, thus providing unexpected bounces. This can be compounded by a variety of axial or off axial spins utilizing either the major or minor axis as a frame of reference. As compared, however, to ordinary handball, the use of the eggball is an advanced level of play. The sponge eggball, being slower, permits safe training at slow speeds until the player can graduate to the pro eggball of my copending application Ser. No. 249,782.

In actual play experiments, children become extremely intrigued and excited when they are able to master even the easiest of throws. A first attempt to throw the ball without any thought as to how it can be controlled results in a random bounce. The sponge eggball, being soft, will not hurt should it rebound to hit the child. However, once taught a spin throw, children are delighted to master and predict the ball's rebound. The smooth, characteristically "rubbery" surface (herein also referred to as "tacky" although adhesion is not implied) and compressibility of the sponge composition permits a good grip upon catching. In an important embodiment, logos of various sponsors, such as fast food franchises, sporting goods manufacturers or exercise equipment manufacturers can be molded into or applied to the ball.

The sponge eggballs of this invention can be made by any conventional sponge rubber or plastic molding process, including control of exterior skin thickness. In the preferred embodiment, a latex rubber or foamable elastomeric plastic composition containing a blowing agent is pumped in liquid form into or extruded into a mold under heat and pressure and cured so the blowing agent forms the voids, and then the sponge eggball is removed from the mold. Typical curing times range from 10–40 minutes at a temperature in the range of from 120° F. to about 160° F. If the density is satisfactory for the softest or beginner grade, they may be cooled and finished, including deflashing, coating or surface printing. If, however, a higher durometer or density sponge is desired for a medium difficulty rebound characteristic, the sponge composition may be adjusted, e.g., reduced blowing agent for smaller, fewer voids and a more dense composition. The skin is formed adjacent the smooth inner surface of the mold. The resulting cured sponge eggballs may then be painted, surface coated with another plastic to impart a more abrasion resistant skin, or, if desired, they may be left totally smooth, removing only flashing to produce the final product.

The sponge material or the exterior skin can be dyed to produce a wide variety of extremely colorful sponge eggballs. The result is an extremely attractive novelty ball, and play or athletic device. The sponge of the body of the sponge eggball is generally opaque and may be in any color, e.g. a uniform white or cream, and overprinted with patterns, text, trademarks and the like. The sponge or skin can be color coded for difficulty, e.g., dayglow green for easiest, yellow for medium bounce and difficulty and blue for hardest, most difficult. It should be understood that no surface skin is required, and, to the extent formed in the molding process, may be sanded off to reveal the sponge core. The sponge may be of graded density with one end, e.g. the large end, being denser than the smaller, parabolic end. The ASTM Test #D-1056 employs a 1×1" square of material ½" thick which is compressed by a load to a thickness of ¼". The load in pounds on the 1 square inch to compress by 50% is the compression deflection number, reported as psi.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

FIG. 1 shows in elevation a sponge eggball of this invention 1 having a major axis 2 in the range from 1.4 to 1.5 times longer than minor axis 3. The sponge eggball, which is preferably made of a sponge rubber compound, has a first, small end 4 which in cross section is generally parabolic, joined to a second generally hemispherical end 5 by a smoothly tapering flatter intermediate section 6. The intermediate section generally has an axial length as long as each of the end sections.

A section has been broken away to show the void-filled interior for good compressibility, and low rebound for safety and gripping characteristics. The line 8 delineates the optional, but preferred, outer skin formed by the smooth inner surface of the mold, or produced by coating with paint or a colored elastomer, so that the sponge eggball has a highly colored appearance. The exterior surface 12 is smooth but slightly "tacky," a characteristic of foam sponge skin. By texturing the mold any surface texture can be produced to permit excellent gripping even with finger tips, and permits hand control of spin along the major or minor axis (or off axis if desired) when thrown. In FIG. 1 the surface is relatively smooth and glossy due to high polish of the mold.

Figure 2:
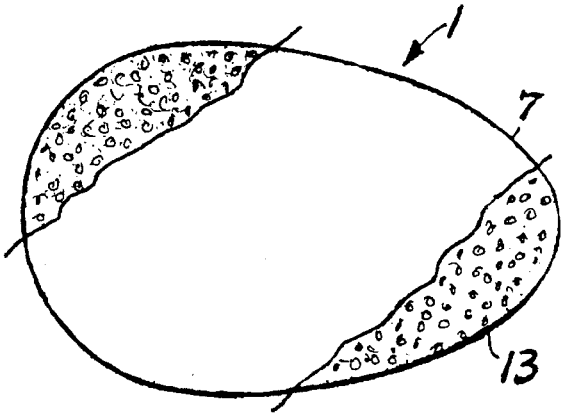
FIG. 2 shows the sponge eggball of this invention in another embodiment having no exterior skin.
Figure 35:
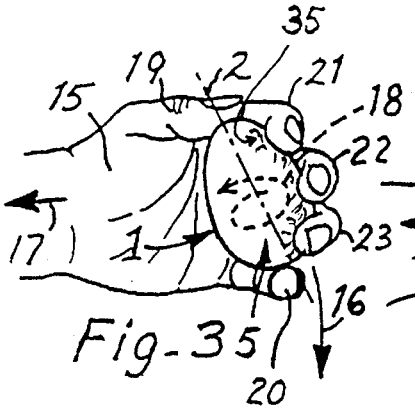

FIG. 2 shows an alternative embodiment in which the sponge eggball 1 has no skin, resulting from removal of the skin by sanding, sandblasting, chemical or physical peeling, or the like.

FIGS. 3–8*c* show various methods of play, exercise or athletic endeavor involving use of the sponge eggball of this invention. FIG. 3 shows eggball 1 being grasped in the left hand 15 of an adult with the large hemispherical section facing downwardly. The ball is thrown down, as illustrated by arrow 16 while at the same time the hand is drawn backward in the direction of arrow 17 to impart spin 18 around the major axis 2. Note that the sponge eggball 1 is sized to fit comfortably between the thumb 19 and little finger 20. The skin permits fingers 21, 22, 23 a gripping surface to impart the spin 18. FIG. 3 shows the basic or beginner throw. Lines 35 represent indentations made when gripping the sponge eggball.

Figure 4:
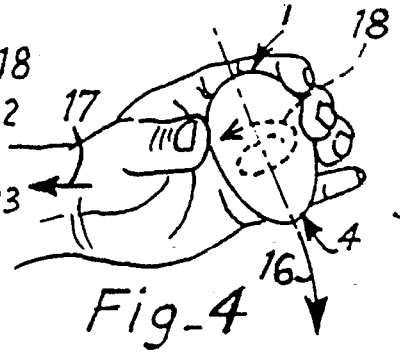
FIG. 4 is a side view showing the sponge eggball grasped with the fingers and thumb of the left hand with the small end downwardly for a more advanced level of play.

FIG. 4 shows grasping the ball for an advanced throw with the small end 4 downwardly. The throw is similar to that of FIG. 3 but the sponge eggball is grasped between the thumb and one or more fingers along the side as shown. With the proper spin 18 the sponge eggball can be controlled to rebound back to the thrower, or to or away from a teammate or other player.

Note that FIGS. 3 and 4 are alternate ways of throwing the sponge eggball, that is, the ball can be thrown with the grasp of FIG. 4 with the narrow end 4 down, or conversely the FIG. 3 grasp can be used to throw the sponge eggball with the wide end 5 down.

Figure 5:
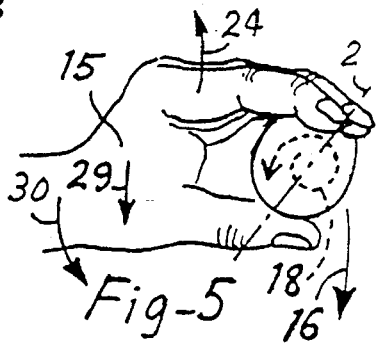
FIG. 5 is a side view showing the sponge eggball oriented with its major axis in a generally horizontal position and grasped by the thumb on the bottom and the fingers on the top to impart a spin so the ball strikes on its side for an intermediate level of play.

FIG. 5 shows an intermediate throw with the major axis 2 being oriented generally horizontally and the sponge eggball thrown downwardly. To impart spin the hand is generally moved downwardly 29 while the wrist is dropped 30, and the fingers simultaneously peel backward off the top of the ball 24, to impart spin 18. By canting the major axis a few degrees from the horizontal the sponge eggball can be made to bounce to the right or left of the thrower.

Figure 6:
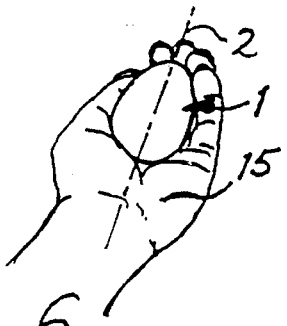
FIG. 6 shows in perspective how to hold the sponge eggball palm-up with the large end of the ball facing the user for throwing against the ground.
Figure 7:
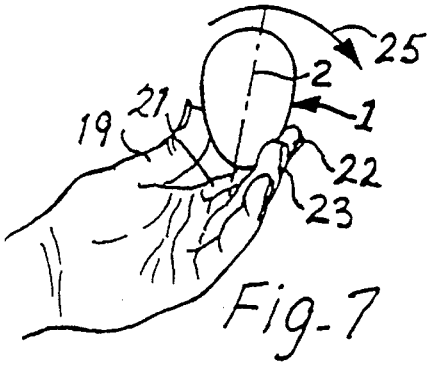
FIG. 7 shows in side view the ball just leaving the fingers for a throw toward the ground.

FIG. 6 shows a method of cradling the eggball in hand 15 preparatory to an end-over-end toss shown in FIG. 7 by arrow 25. Note in FIG. 7 the ball is last gripped by thumb 19 and fingers 21, (not seen) 22, 23 at release.

Figure 8A:
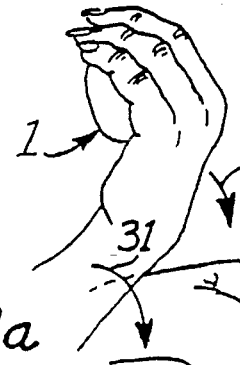
FIG. 8*a* and 8*b* and 8*c* are a series of side views showing the wrist motion for a typical ground throw.
Figure 8B:
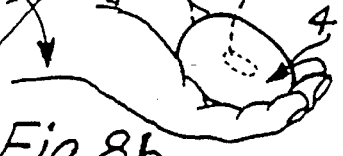
Figure 8C:
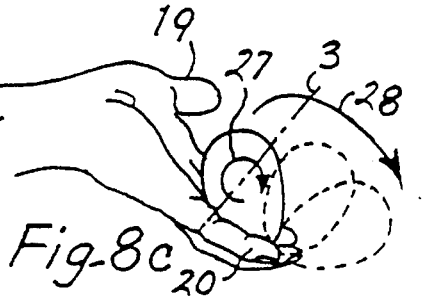

FIGS. 8*a, b, c* show an alternate end-over-end long distance throw in which the wrist is dropped first as shown by arrow 31, while the hand rotates as shown by arrow 26. This imparts forward momentum and spin on the minor axis 3, while the thumb 19 is held to the side (FIG. 8*c*). At the point of release the index finger, 21 (not seen) and little finger 20 guide the sides of the ball adjacent the parabolic end while spin 27 around minor axis 3 is imparted with the ball going end over end as shown by arrow 28. Long distance bounces can be imparted to the eggball in this manner.

It should be understood that various modifications within the scope of this invention can be made by one of ordinary skill in the art without departing from the spirit thereof. For example, the ball can be made in parts and glued together with a suitable adhesive or solvent glue. In this embodiment, the wide end 5 can be made of sponge of a greater density than the upper sections 4 and 6 and may be glued together along parting line 36 (FIG. 1). The sponge material need not be uniform in color. For example, swirls or color streaks can be produced from partial mixing of two latex elastomers of different colors, and the surface of the ball will exhibit these color swirls where the skin is self-formed in the mold, the skin is transparent, or there is no skin.

I therefore wish my invention to be defined by the scope of the appended claims as broadly as the prior art will permit, and in view of the specification if need be.

I claim:

1. A sponge-type ball for amusement exercise and athletic competition comprising in operative combination:

a) a solid body of generally egg-shaped exterior configuration having a first major axis and a second minor axis;

b) the ratio of said major axis to said minor axis lying within the range of about 1.3 to about 1.6;

c) said ball has a first small end generally parabolic in cross section, a second, opposed, larger end of generally hemispherical configuration, and an intermediate zone having a smooth generally flattened curve so that said opposed ends smoothly fair into said intermediate zone;

d) said ball is composed of a sponge elastomer having a density in the range of from about 5 to about 20 psi as determined by ASTM D-1056;

e) said ball has a length in the range of about 2½" to about 4½" along its major axis;

f) said ball has a mass in the range of from about 30 to 90 grams; and g) said ball is of a size to fit comfortably in the human hand between the index and little fingers and which is controllable to impart spin along selective ones of said axes to control the rebound thereof.

2. A sponge eggball as in claim 1 wherein:

a) the surface of said ball has an outer skin.

3. A sponge eggball as claim 1 wherein said sponge elastomer is colored.

4. A sponge eggball as in claim 3 wherein said sponge elastomer includes at least two colors which are visible on the outer surface of said sponge eggball.

5. A sponge eggball as in claim 1 wherein said body is composed of a plurality of foamed elastomer pieces bonded together to form a unitary whole.

6. A sponge eggball as in claim 5 wherein at least some of said elastomer pieces are higher density than others.

7. A sponge eggball as in claim 1 wherein said sponge body composition includes swirls of color which are visible from the exterior.

8. A sponge eggball as in claim 2 wherein:

a) at least a portion of the outer skin surface is textured.

9. A sponge eggball as in claim 1 which has no surface skin.

10. A sponge eggball as in claim 2 wherein:

a) said surface skin is opaque, transparent, translucent or contains an additive which when exposed to light, glows in the dark.

11. A sponge eggball as in claim 1 wherein at least some of said sponge elastomer includes at least one additive which when exposed to light, glows in the dark.

12. A sponge eggball as in claim 2 wherein:

a) said outer skin surface has applied to at least portions thereof a coating having at least one additive which when exposed to light, glows in the dark.

13. A sponge eggball as in claim 1 wherein:

a) the length of said eggball along its major axis ranges from about 3" to about 4";

b) the weight of said ball ranges from about 50 to 70 grams; and c) the density of said sponge body ranges from about 10 psi to about 12 psi as determined by ASTM D-1056.

14. A sponge eggball as in claim 13 including:

a) an outer surface skin which is opaque, transparent, translucent or contains an additive which when exposed to light, glows in the dark.

15. A sponge eggball as in claim 13 wherein said body is composed of a plurality of foamed elastomer pieces bonded together to form a unitary whole.

16. A sponge eggball as in claim 15 wherein at least some of said elastomer pieces are higher density than others.

17. A sponge eggball as in claim 13 which includes swirls of color which are visible from the exterior.

18. A sponge eggball as in claim 14 wherein:

a) at least a portion of said outer surface is textured.

19. A method of play with a sponge eggball comprising:

a) providing a sponge eggball as in claim 1;

b) grasping said sponge eggball with at least one hand;

c) throwing said sponge eggball against a floor, the ground or a wall while imparting a spin around at least one of said axes to control and direct the rebound back to the person throwing the ball, or to or away from another player.

20. A method of play with a sponge eggball comprising:

a) providing a sponge eggball as in claim 13;

b) grasping said sponge eggball with at least one hand;

c) throwing said sponge eggball against a floor, the ground or a wall while imparting a spin around at least one of said axes to control and direct the rebound back to the person throwing the ball, or to or away from another player.

* * * * *